US009815602B1

(12) United States Patent
Ness

(10) Patent No.: US 9,815,602 B1
(45) Date of Patent: Nov. 14, 2017

(54) TANK CLOSURE APPARATUS

(71) Applicant: Tom Gurtner, New Orleans, LA (US)

(72) Inventor: Daniel W. Ness

( * ) Notice: Subject to any disclaimer, the term of this patent is extended or adjusted under 35 U.S.C. 154(b) by 0 days.

(21) Appl. No.: 14/692,892

(22) Filed: Apr. 22, 2015

Related U.S. Application Data

(63) Continuation of application No. 11/535,272, filed on Sep. 26, 2006, now abandoned.

(60) Provisional application No. 60/735,449, filed on Nov. 10, 2005.

(51) Int. Cl.

| | |
|---|---|
| ***A23G 9/28*** | (2006.01) |
| ***B65D 51/18*** | (2006.01) |
| ***B65D 41/04*** | (2006.01) |
| ***B65D 43/02*** | (2006.01) |
| ***B65D 45/16*** | (2006.01) |
| ***B65D 88/02*** | (2006.01) |

(52) U.S. Cl.
CPC ..... *B65D 51/18* (2013.01); *B65D 41/04* (2013.01); *B65D 43/02* (2013.01); *B65D 45/16* (2013.01); *B65D 88/02* (2013.01); *B65D 2251/009* (2013.01); *B65D 2251/0015* (2013.01); *B65D 2251/0028* (2013.01); *B65D 2251/0081* (2013.01); *B65D 2543/00231* (2013.01)

(58) Field of Classification Search
CPC ..... B65D 51/18; B65D 41/04; B65D 43/02; B65D 45/16; B65D 88/02; B65D 2251/0015; B65D 2251/0028; B65D 2251/0081; B65D 2251/009; B65D 2543/00231
USPC ..... 220/321, 324, 565, 582
See application file for complete search history.

(56) References Cited

U.S. PATENT DOCUMENTS 3,371,822 A * 3/1968 Galloway ..... A23G 9/045 220/86.1
3,635,370 A * 1/1972 Romanauskas ..... B04B 5/0414 220/227

* cited by examiner

*Primary Examiner* — Fenn C Mathew
*Assistant Examiner* — Elizabeth Volz
(74) *Attorney, Agent, or Firm* — Garvey, Smith & Nehrbass, Patent Attorneys, L.L.C.; Charles C. Garvey, Jr.; Vanessa M. D'Souza

(57) ABSTRACT

A tank and closure cap apparatus is disclosed. The tank has an upper end or top with a manhole like larger diameter opening that can be closed with a lid having a smaller diameter opening equipped with an outlet fitting. A specially configured shroud protectively covers the lid clamp and is secured with a closure cap that seals the outlet fitting.

9 Claims, 3 Drawing Sheets

TANK CLOSURE APPARATUS

CROSS-REFERENCE TO RELATED APPLICATIONS

This is a continuation of U.S. patent application Ser. No. 11/535,272, filed Sep. 26, 2006, which claims benefit of U.S. Provisional Patent Application Ser. No. 60/735,449, filed Nov. 10, 2005, priority of each is hereby claimed.

Priority of U.S. Provisional Patent Application Ser. No. 60/735,449, filed Nov. 10, 2005, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a closure apparatus for a tank that can be used to contain various materials and that is preferably transportable to a remote location such as an offshore oil drilling or production platform. More particularly, the present invention relates to an improved tank closure apparatus that enables one of two dispensing openings to be used for gaining access to the tank interior, the larger opening being closable with a circular lid that is clamped in position with a ring, wherein the ring closure is cam operated with a locking lever and further providing a specially configured shroud that protectively covers the clamping ring while at the same time allowing access to the tank interior via the smaller opening.

2. General Background of the Invention

In the oil and gas well drilling and production industry, large tanks are often used to carry fluids to an offshore location such as an offshore oil well drilling or production platform. These tanks can carry any number of fluids that are used in the drilling or production process. One commercially available, known tank provides tank side walls, a tank upper end portion or top and two different closures or two different openings. These openings include a larger opening that is closed with a circular lid and held in place with a clamping ring. The closures also include a smaller opening that is at the center of the lid and that is in the form of a threaded outlet fitting.

Presently, the clamping ring is held in position with a bolted connection that gradually tightens the ring against a pair of annular ribs. Such a clamping ring is time consuming to install.

BRIEF SUMMARY OF THE INVENTION

The present invention provides an improved tank closure apparatus wherein the tank is in the form of a tank body having a side wall and an upper end portion or top. A larger opening is provided in the top such as a circular opening.

A lid can be fitted to the larger opening for closing it, the lid having a central smaller opening. Both the tank top at the larger opening and the lid have annular ribs that can be aligned and clamped together using an annular clamp ring.

With the present invention, the annular clamp ring is provided with a cam locking mechanism that can quickly be closed, tightly securing the lid to the tank top at the larger opening using a lever. A specially configured shroud is affixable to the combination of lid and clamping ring.

The specially configured shroud provides a central opening that enables a threaded fitting on the lid to fit through the shroud.

The shroud is held in position when an internally threaded cap is attached to the outlet fitting, the cap being of a larger diameter than the largest portion of the opening at the center of the shroud.

The shroud can be provided with a slotted portion that preferably communicates with the larger diameter circular part of the shroud opening for enabling a cable to pass through the slot, the cable being attached to both internally threaded cap and lid.

DETAILED DESCRIPTION OF THE INVENTION

Figure 1:
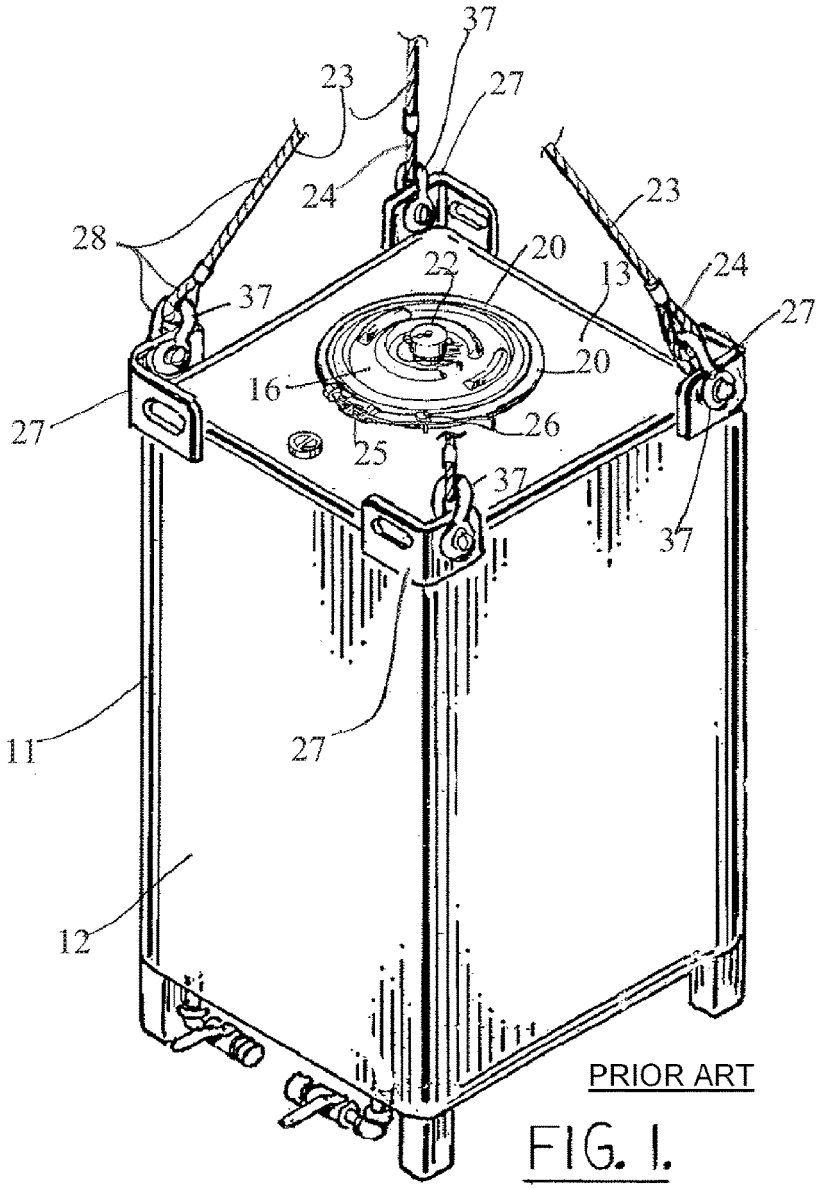
PRIOR ART FIG. 1.
FIG. 1 is a perspective view of a known prior art tank.
Figure 4:
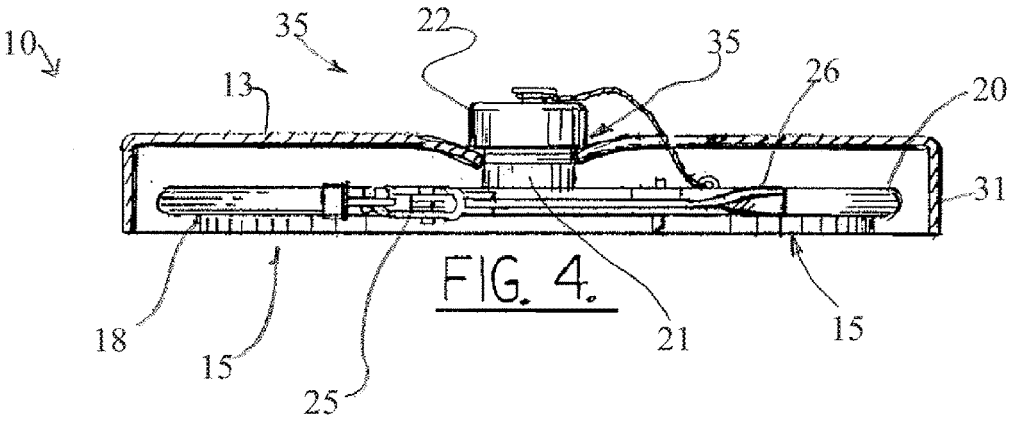
FIG. 4 is a sectional view of the preferred embodiment of the apparatus of the present invention.
Figure 2:
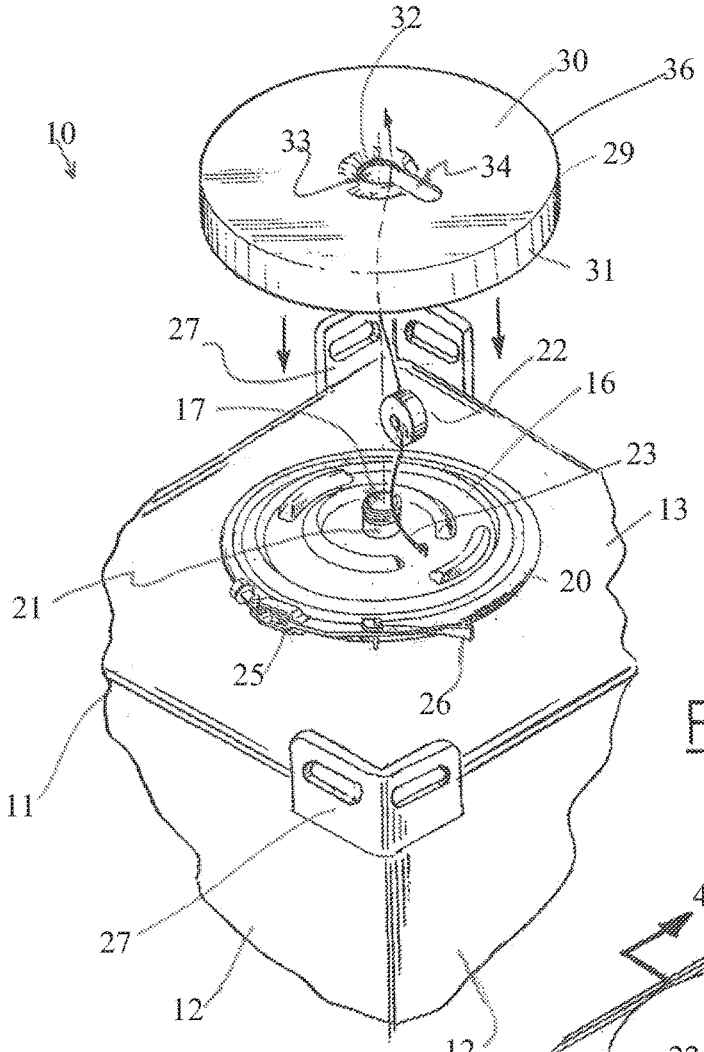
FIG. 2 is a perspective view of the preferred embodiment of the apparatus of the present invention.
Figure 3:
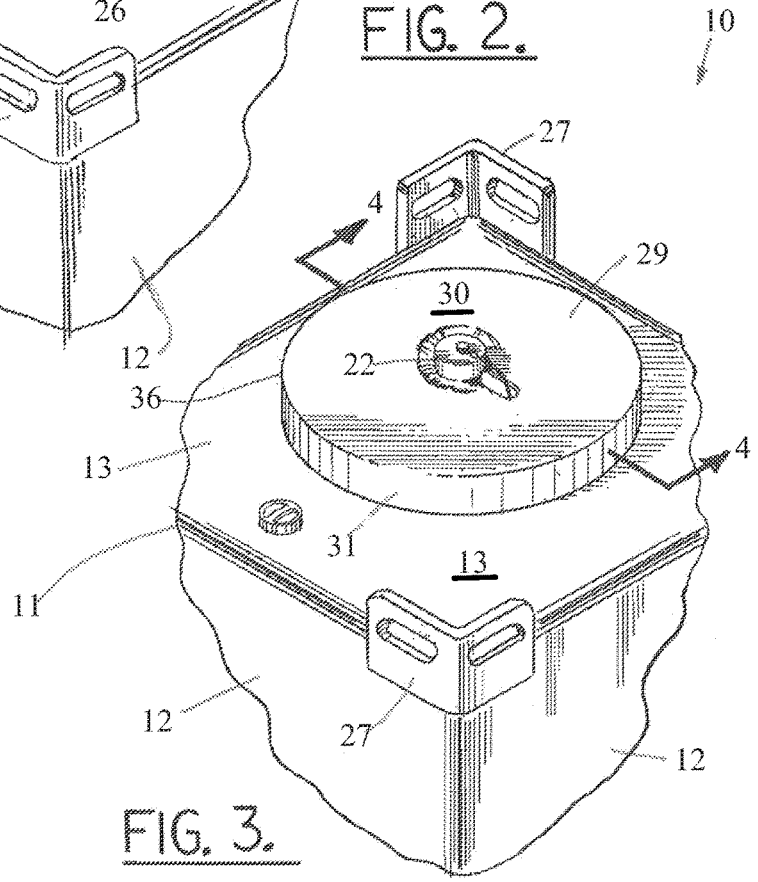
FIG. 3 is a partial perspective view of the preferred embodiment of the apparatus of the present invention.
Figure 5:
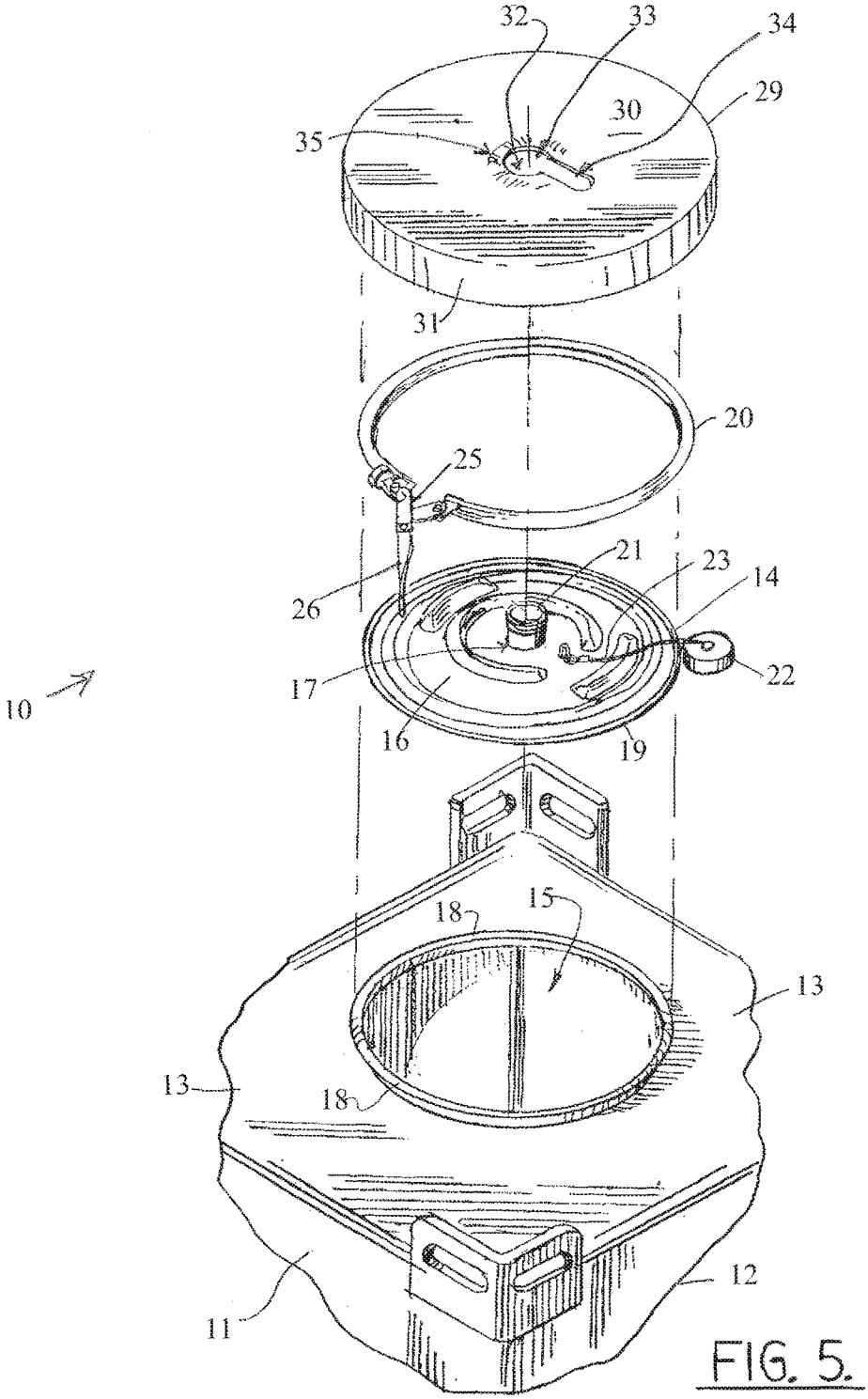
FIG. 5 is a perspective exploded view of the preferred embodiment of the apparatus of the present invention.

FIGS. 1-6 show the preferred embodiment of the apparatus of the present invention designated generally by the numeral 10. Tank closure apparatus 10 includes a tank 11 that has a bottom wall, side walls 12, and an upper end portion or top 13. The top 13 has a larger diameter opening 15 that is fitted with a closure 14 that includes a lid 16 that is circular in shape (corresponding in diameter to the larger diameter opening 15), fitting 21, and cap 22. Cap 22 can be tethered to lid 14 using cable 23.

Lid 16 provides a smaller opening 17 that can be fitted with an externally threaded outlet fitting 21. The top 13 and larger opening 15 provides an annular rib 18. Similarly, lid 16 provides a correspondingly sized annular rib 19. These ribs 18, 19 are generally aligned and held together with an annular clamp ring 20. It should be understood that a tank 11 having side walls 12, top 13 and larger diameter opening 15 is well known in the art. Further, such tanks are known in the art to be provided with a lid 16 that provides a smaller opening 17. To connect the lid to the tank using an annular clamp ring is also known in the art. In the prior art, such annular clamp rings 20 have been secured using a bolted connection.

The closure 14 of the present invention provides a cam locking mechanism 25 as part of an annular clamp ring 20 as shown. The cam locking mechanism 25 can be quickly closed using lever 26 to secure the annular ribs 18, 19 together an thus fasten lid 16 at larger diameter opening 15 to tank 11 top 13.

Lid 16 provides an opening that is receptive of the externally threaded outlet fitting 21. An internally threaded cap 22 can be secured to externally threaded outlet fitting 21 forming a closure to the outlet fitting 21 as shown in FIGS. 1-2, 4 and 7. A lanyard or cable 23 can be used to secure cap 22 to lid 16.

Tank 11 can be lifted using a plurality of lifting eyes 27 and rigging 28. Rigging 28 can include cables 23 and eyelets 24. In order to protect cam locking mechanism 25 and its lever 26 from entangling with any part of rigging 18, a specially configured shroud 29 is provided by the method and apparatus of the present invention.

Shroud 29 provides a circular plate 30 to which is attached annular shoulder 31. The central opening 32 is provided in circular plate 30. Opening 32 includes a circular section 33 and an elongated slot 34. A concavity 35 can be provided next to opening 32 so that cap 22 can be added to fitting 21 after shroud 29 has been placed in position, covering the combination of annular ribs 18, 19, lid 16, externally threaded outlet fitting 21 and cam locking mechanism 25.

The internally threaded cap 22 has a diameter that can be larger than the diameter of the circular section 33 of opening 32. Thus, once the cap 22 is attached to the externally threaded outlet fitting 21, cap 22 retains shroud 29 in its protected position, shown in FIGS. 1, 2 and 4.

The following is a list of suitable parts and materials for the various elements of the preferred embodiment of the present invention.

PARTS LIST

| Parts Number | Description |
|---|---|
| 10 | tank closure apparatus |
| 11 | tank |
| 12 | side wall |
| 13 | top |
| 14 | closure |
| 15 | larger opening |
| 16 | lid |
| 17 | smaller opening |
| 18 | annular rib |
| 19 | annular rib |
| 20 | annular clamp ring |
| 21 | externally threaded outlet fitting |
| 22 | internally threaded cap |
| 23 | cable |
| 24 | eyelet |
| 25 | cam locking mechanism |
| 26 | lever |
| 27 | lifting eye |
| 28 | rigging |
| 29 | shroud |
| 30 | circular plate |
| 31 | annular shoulder |
| 32 | opening |
| 33 | circular section |
| 34 | elongated slot |
| 35 | concavity |

The foregoing embodiments are presented by way of example only; the scope of the present invention is to be limited only by the following claims.

The invention claimed is:

1. A tank closure apparatus comprising:

a) tank body having a tank outer wall, tank surrounding a tank interior, the body having a top with an upper surface and lift fittings with openings, wherein the openings in the lift fittings are located above the top upper surface;

b) the top having a first, larger diameter opening;

c) a lid that forms a closure to the larger diameter opening the lid having a central, smaller diameter opening;

d) a threaded outlet fitting attached to the lid at the smaller diameter opening, said outlet fitting having an upper portion, a lower portion attached to the lid and threads that extend from the upper portion downwardly to a lower most thread;

e) the lid and the tank body top each having an annular rib, said ribs being aligned and abutting to define a closed position of the lid upon the larger diameter opening;

f) a clamp that holds the annular ribs together;

g) a closure cap that can be removably attached to the outlet fitting, a tether provided on the lid that goes between the closure cap and the lid;

h) a guard that envelops the lid and the clamp, the guard including a disk part having a peripheral portion, and a downwardly extending annular shoulder attached to the peripheral portion, wherein the annular shoulder extends downwardly from the peripheral portion to the top upper surface;

I) a central guard opening having a diameter that is larger than the diameter of the outlet fitting, the guard having a slot that extends laterally away from said central guard opening, and wherein said tether occupies said slot;

j) a concavity provided on the disk part next to the guard opening, wherein the concavity extends downwardly to position the central guard opening below at least some of the outlet fitting threads;

k) wherein the closure cap has a diameter that is greater than the diameter of the guard opening l) wherein the annular shoulder is spaced radially away and outwardly from the clamp, in between the clamp and the lift fittings; and m) wherein the height of the bottom of said concavity to the tank body top is smaller than the height of the bottom of the disk peripheral portion to the tank body top.

2. The tank closure apparatus of claim 1 wherein the lid is generally circular.

3. The tank closure apparatus of claim 1 wherein the outlet fitting is externally threaded.

4. The tank closure apparatus of claim 3 wherein the closure cap is internally threaded.

5. The tank closure apparatus of claim 2 wherein the guard is cylindrically shaped.

6. The tank closure apparatus of claim 1 wherein the guard disk part has an overall diameter.

7. The tank closure apparatus of claim 1 wherein the guard annular shoulder is generally cylindrically shaped.

8. The tank closure apparatus of claim 6 wherein the annular shoulder has a height.

9. The tank closure apparatus of claim 7 wherein the disk part overall diameter is greater than the annular shoulder height.

* * * * *